US005738581A

United States Patent [19]

Rickert et al.

[11] Patent Number: 5,738,581

[45] Date of Patent: Apr. 14, 1998

[54] ROOF VENTILATION ELEMENT

[75] Inventors: Hubert Rickert, Nagold, Germany; Fritz Gödl, Ennetbürgen, Switzerland

[73] Assignee: Norm A.M.C. AG, Erstfeld, Switzerland

[21] Appl. No.: 788,662

[22] Filed: Jan. 24, 1997

[30] Foreign Application Priority Data

Jan. 27, 1996 [DE] Germany ..... 196 02 979.1
May 28, 1996 [EP] European Pat. Off. ..... 96108425

[51] Int. Cl.[6] ..... F24F 7/02
[52] U.S. Cl. ..... 454/365; 52/199
[58] Field of Search ..... 454/365, 366; 52/57, 199

[56] References Cited

U.S. PATENT DOCUMENTS

| | | | |
|---|---|---|---|
| 5,002,816 | 3/1991 | Hofmann et al. | 454/365 C |
| 5,332,393 | 7/1994 | Godl | 454/365 |
| 5,593,348 | 1/1997 | Rickert | 454/365 |

FOREIGN PATENT DOCUMENTS

| | | | |
|---|---|---|---|
| 0 117 391 | 9/1984 | European Pat. Off. . | |
| 0 288 020 | 10/1988 | European Pat. Off. | 454/365 |
| 295 04 548 | 8/1995 | Germany . | |
| 44 01 139 | 8/1995 | Germany . | |
| 44 04 166 | 8/1995 | Germany . | |

*Primary Examiner*—Harold Joyce
*Attorney, Agent, or Firm*—Sixbey, Friedman, Leedom & Ferguson; David S. Safran

[57] ABSTRACT

A ventilation element (1) for roofs having a vent cap (3) to be located in the ridge, slope, or arris region of the roof and having at least one elastically flexible sealing member (7) which adjoins the edge area (4, 6) of the vent cap (3). According to the invention, an optimum seal between the vent cap (3) and the roofing material is ensured by the fact that the sealing element (7) is made as a hollow body (10) with a preferably roughly pear-shaped cross section, which is closed in a free edge area and in its area which is adjacent to the edge areas (4, 6) of the vent cap (3). Slits (41) can be provided in the hollow body to allow the egress of air from the roof, in part, through the hollow body without adversely affecting its sealing function.

13 Claims, 8 Drawing Sheets

ROOF VENTILATION ELEMENT

BACKGROUND OF THE INVENTION

1. Field of the Invention

The invention relates to a roof ventilation element with a vent cap to be located in the ridge, slope, or arris region of a roof and which has at least one elastically flexible sealing member which adjoins the vent cap on its edge area.

2. Description of Related Art

Use of foam sealing members in ventilation elements of the type under consideration is known. The disadvantage is that, for various spacing differences and/or sharp-edged transitions, due to its structure, the foam is not able to achieve sufficient tightness, for example, against blowing snow and driving rain. Furthermore, it is disadvantageous that the foam is not resistant to aging, and therefore, embrittles and crumbles over time, so that serviceability is not ensured. Furthermore, foam requires strong compression which makes placement difficult and often leads to unsatisfactory working and sealing results. Finally, accessible areas are exposed to bird damage.

Use of a brush strip as the sealing member for ventilation elements is furthermore known, the brush strip having a host of elastic brush filaments located in a packing which is flow-tight, at least for the most part. The disadvantage is that the fine filaments can, therefore, bend at the individual filament tips, for example, when they come into contact with barriers such as rough spots, edges, etc., endangering tightness. Finally, in critical areas, for example, in corner areas, it is not ensured that the brush filaments extend into these areas. Furthermore, the brush filaments tend to line up or when greatly heated to rise and when cooled no longer return to their initial position, by which blowing snow and driving rain can penetrate into the areas exposed in this way, especially with wind pressure. Still Further, there is the danger that ambient effects and strong incident solar radiation (UV radiation) embrittle and break the very fine brush filaments; this in turn greatly reduces tightness. Another disadvantage is that, with strong wind pressure, the brush filaments are spread apart in the shape of a wedge, and thus, large entry openings for blowing snow and driving rain are formed. It also happens that the fine brush filaments stick together due to ambient effects and clog up like rake teeth, creating open spaces through which blowing snow and driving rain can penetrate. In addition, the loose brush filaments lose their most important property, that is, elasticity, by which tightness is greatly reduced.

SUMMARY OF THE INVENTION

In view of the foregoing, a primary object of the invention is to provide a ventilation element of the initially mentioned type in which an optimum seal is ensured and which adapts uniformly and homogeneously to any roofing material.

This object is achieve by a ventilation element according to the present invention in which the sealing member is made as a hollow body with a preferably pear-shaped cross section, which is closed in its areas which are closest to and farthest from the edge area of the vent cap. Because the sealing member is made as an elastically deformable body, it is able to adapt to any roofing material, for example, a tile-shaped roofing material, corrugated roofing material or roofing material with some other profile. The sealing member made according to the invention can be placed very easily both in depressions and also on elevations of the roofing material. This largely prevents the entry of blowing snow and driving rain.

In the ventilation element according to the invention, the hollow body of which the sealing member is comprised is formed, preferably, by a wrapped or folded flat base material. Two sides of the flat base material are placed on top of one another, yielding a hollow body which, as already stated, has a, preferably, somewhat pear-shaped cross section. By wrapping or folding the flat base material into the hollow body which forms the sealing member, the properties of the flat base material, especially elasticity, are more advantageously used, specifically by the hollow body formed in this way having high adaptability, ensuring uniform sealing between the vent cap and the roofing material.

For ventilation elements of the type under consideration, it applies that, fundamentally, venting takes place via the air passage openings in the vent cap; these air passage openings can have any cross section, especially a round or oval cross section. The sealing member which acts between the vent cap and roofing material has essentially two functions. On the one hand, the sealing member, as already stated, is designed to prevent the entry of blowing snow and driving rain. On the other hand, the sealing member also is designed to prevent air which can adversely affect the ventilation function of the ventilation element overall, therefore, mainly the ventilation function of the vent cap, from entering underneath the vent cap into the interior.

With consideration of what has been stated above on the basic function of the ventilation elements according to the invention, the hollow body can have slits, notches, undercuts, or recesses which lead mainly to an increase in the elasticity of the sealing member. These notches, undercuts or recesses, surprisingly, do not have an adverse effect on the above described basic function of the ventilation elements. Rather, these slits, notches, undercuts or recesses can even provide an advantage in terms of ventilation engineering above and beyond the function of increasing the elasticity of the sealing member. Surprisingly, it has been found that the design of the sealing member according to the invention leads to different flow resistances. While the flow resistance from the outside to the inside, as required, is relatively great, the flow resistance from inside to outside is much less. Consequently unwanted penetration of air from the outside to the inside is prevented, but air is enabled to flow from the inside to the outside via the sealing member.

If, in the ventilation element according to the invention, the hollow body has slits, they run preferably transversely to the length of the sealing member, especially at an angle of less than 90°. In particular, the slits can run at an angle to the lengthwise direction of the sealing member such that, in the area adjacent to the edge area of the vent cap, the strip-shaped parts which are formed by the slits overlap or cross, in part or in whole.

The ventilation element according to the invention can be formed of a vent cap and one or more separate sealing members, and therefore, can be made in several pieces. Then, it is recommended that the sealing member be provided with a connecting strip in its area adjacent to the edge area of the vent cap. In this version, the sealing member can be inserted with a connecting strip into a groove provided in the edge area of the vent cap.

One especially advantageous embodiment of the ventilation element according to the invention is has the vent cap and the sealing member or the vent cap and the sealing members made of a one-piece construction. This has advantages for both production and installation.

Finally, an embodiment of the ventilation element according to the invention that is especially advantageous has the ventilation element made as a flexible sealing strip which, in particular, can be wound onto or off of a roll. This embodiment makes it possible to first wind the ventilation element or ventilation strip which is produced in relatively long lengths so that space-saving storage or space-saving transport is possible. On site, specifically on the roof to be equipped with such a ventilation element, the ventilation element or sealing strip is simply rolled out over the ridge lath, positioned and attached. The time and cost required for mounting of the ventilation element made in this way is, consequently, extremely low.

The subject matter of the invention is not only the above described ventilation element, but also a process for producing such a ventilation element. This process is comprises extrusion of the vent cap and the flat base material for the sealing member, after which the flat base material for the sealing member is joined on one side to the vent cap in its edge area and then, finally, the flat base material for the sealing member is folded to form a hollow body and its free side in the edge area of the vent cap is joined to the vent cap or to the base material in the area of this flat base material for the sealing member which adjoins the edge area of the vent cap.

If the ventilation element to be produced is one in which the vent cap and the sealing member or the vent cap and the sealing members are made in one piece, the above described process can be accomplished such that the vent cap and the base material for the sealing member are extruded in one piece.

The joining of the base material for the sealing member to the vent cap which is necessary in the above described process for producing a ventilation element according to the invention can be done in various ways. In particular, it is recommended that welding or cementing be used.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
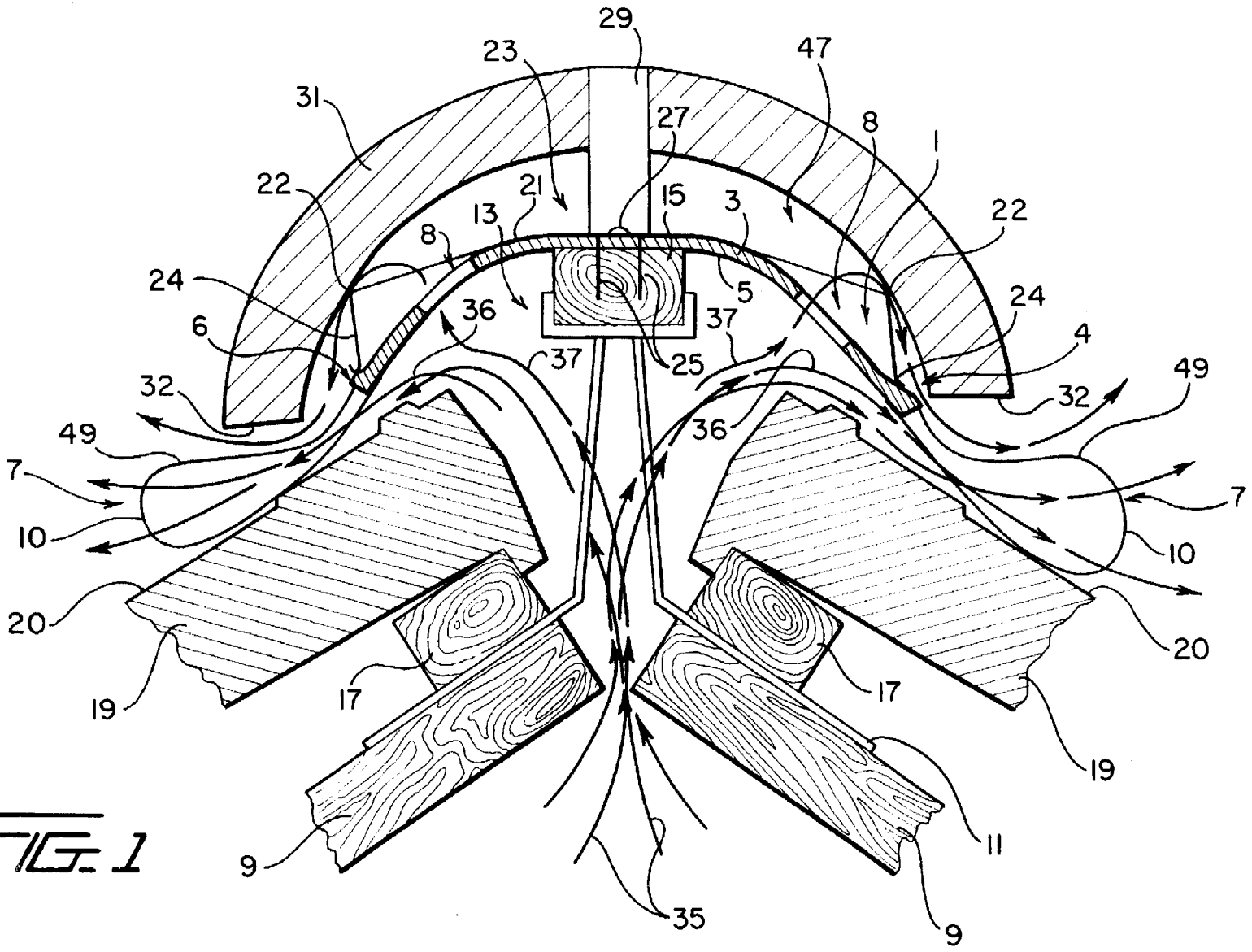
FIG. 1 shows a cross section through the ridge area of a roof of a building having a first embodiment of a ventilation element according to the invention.

FIG. 1 shows ventilation element 1 which can be used in the ridge, slope, or arris region of a roof. Ventilation element 1 has a strip-shaped vent cap 3 with a first edge area 4, a middle area 5, a second edge area 6 and sealing members 7 joined to the edge areas 4, 6. A lath holder 11, which has a U-shaped profile 13 into which ridge lath 15 is inserted, is attached to counterlaths 9. Furthermore, a lathwork, of which only the laths 17 are shown, is attached to counterlaths 9. Tiles 19 are hung on the laths 17.

Figure 6A:
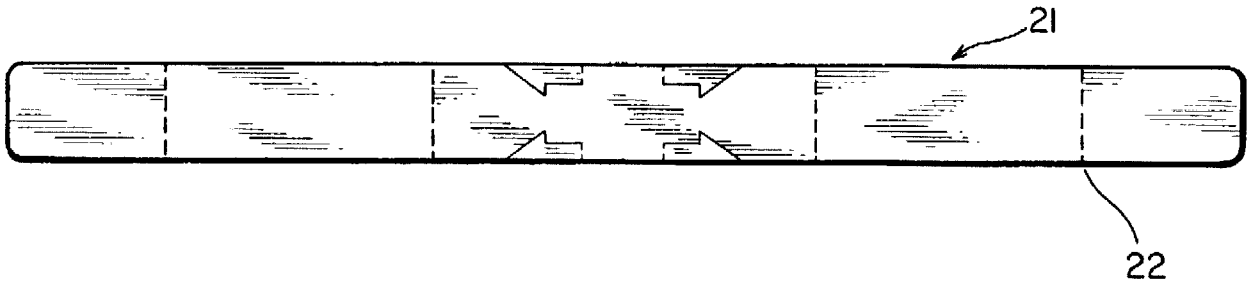
FIGS. 6(*a*) & (*b*) show, respectively, a side view and a plan view of a spacer of the invention, and FIG. 6(*c*) is an enlarged view of detail A in FIG. 6(*b*)
Figure 6B:
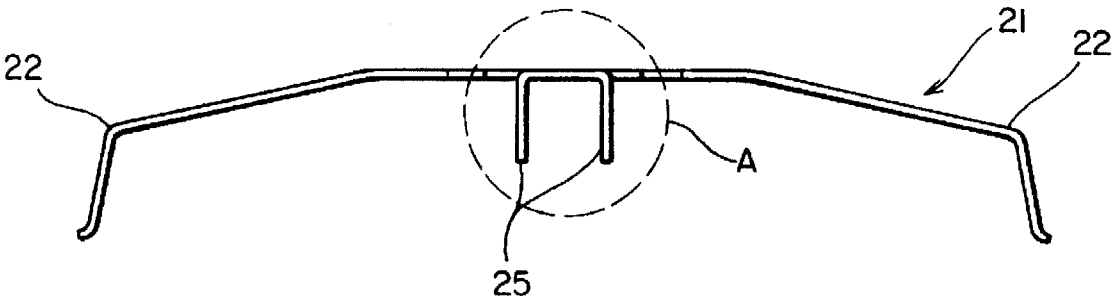
Figure 6C:
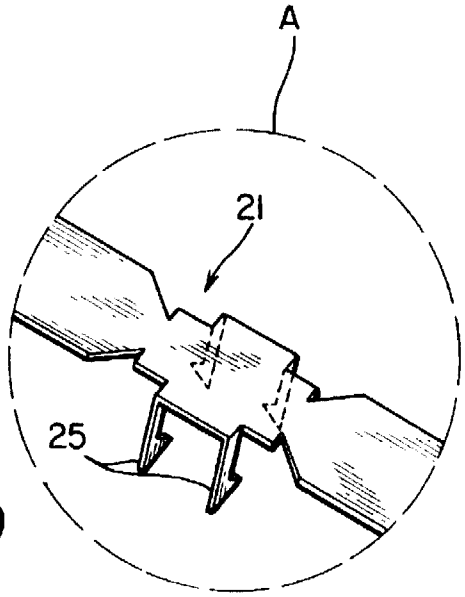

Vent cap 3 rests with its middle area 5 on the ridge lath 15 and is held on the ridge lath 15 by spacers 21 which are shown in FIG. 6 and which are spaced apart along the length of the vent cap 3. Each spacer 21 is attached to the ridge lath 15 by means of its attachment area 23 using nail-like pins 25. Ridge clamps which are used to fix ridge files 31 are attached to ridge lath 15 using screws 27. The ridge files 31 are borne by bearing edges 22 of spacers 21. Spacers 21 shape vent cap 3 by edges 24, i.e., vent cap 3 is pressed down by spacers 21, by which it is reversibly or elastically deformed.

Sealing members 7 are attached to both edge areas 4, 6 of the vent cap 3. This can be done, for example, by means of a clip connection, adhesive bond, or screw connection. Alternatively, a one-piece implementation is also conceivable. "One-piece" means that ventilation element 1 is formed from a single piece of material. Sealing members 7 are used to close the irregularly sized gaps between the top 20 of tiles 19 and the bottom 32 of ridge tiles 31 such that, on the one hand, air circulation in the ridge area is possible and that, on the other hand, penetration of blowing snow and driving rain is prevented.

According to the invention, each sealing member 7 is made as a hollow body 10 which is closed in the area of its free end (i.e., the end which is away from the edge areas 4, 6 of the vent cap 3 and in its area which is adjacent to the edge areas 4, 6 of the vent cap 3. This means that the hollow body 10 extends from the area of the sealing member 7 which adjoins edge areas 4, 6 of the vent cap 3 as far as its end remote from edge areas 4, 6 of the vent cap 3.

For the essence of the invention, however, it is not necessary for the hollow body 10 to extend on both sides as far as has already been explained. It is possible that the hollow body 10 does not begin immediately where sealing member 7 adjoins edge areas 4, 6 of the vent cap 3. It is also possible for hollow body 10 to end inward the free end of the sealing member 7.

Sealing members 7 are shown folded and have slits 41 which cannot be seen in FIG. 1, but are shown in FIGS. 3–5, 7 and 9. The slits 41 are spaced apart and extend transversely to the longitudinal extension of the sealing element 7. The slits 41 are made in sealing member 7 such that the ends 42 and 42' of slits 41 are at a distance from the area in which the two edges of the base material of sealing member 7 lie on top of one another in the folded-together state. The base material for sealing member 7 is folded over after slits 41 are made and the folded-over portions are held together in the aforementioned manner at connection area 43. Slits 41 are made in the ventilation element 1 by a punching or cutting process while element 1 is in its original, flat form before the folding process. If, in this machining process, material is removed at the separation point, undercuts are made. In the case of slits, no material is removed.

Figure 4A:
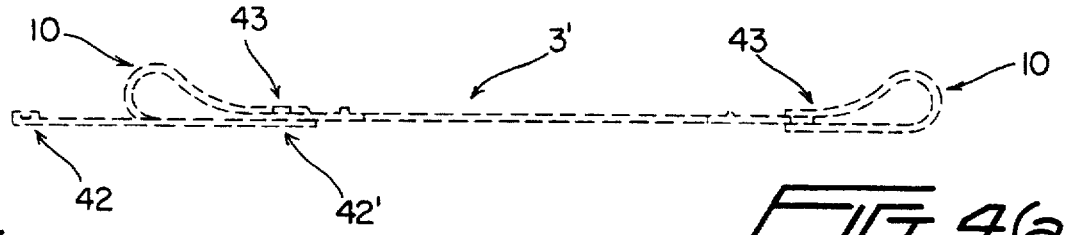
FIGS. 4(*a*) & (*b*) show, respectively, a side view and a plan view of the ventilation element according to the invention for use in the FIG. 1 embodiment.
Figure 4B:
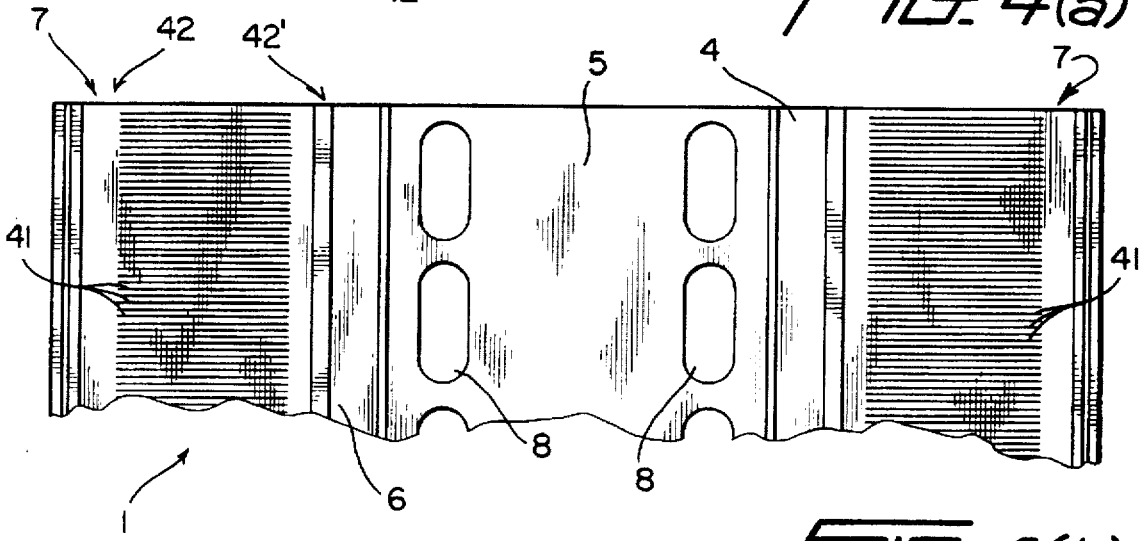

How sealing member 7 works will now be explained with reference to the arrows in FIG. 1 which represent the air circulation paths. The air flow 35 travels in the roof superstructure from the eaves to the ridge where it is divided into two air flows 37 and 36. Air flow 37 passes through air passage openings 8 of strip-shaped vent cap 3 and reaches an intermediate space 47 which is formed between the ventilation element 1 and the ridge tile 31. From there, air flow 37 passes to the outside through a gap which is formed between the bottom 32 of ridge tile 31 and the top 49 of the sealing element 7. Air flow 36 passes through slits 41 of hollow body 10, i.e., the air flows through slits 41 into hollow body 10 and from there through slits 41 to the outside. It is also possible, under special weather conditions, for the air flow 35 to escape exclusively as flow 37 via the air passage openings 8 and the gap between the bottom of ridge tile 31 and the top of sealing member 7. The air passage openings 8 through which venting takes place can have any cross-sectional shape, especially a round or oval cross section as shown in FIGS. 4(*b*) and 5(*b*).

It is also not required for the flow 36 through the seal element 7 to be possible. Thus, instead of slits 41, the hollow body can have corresponding notches, undercuts, or recesses which served to increase the elasticity of the sealing members 7 without creating an air flow path through them.

Figure 3:
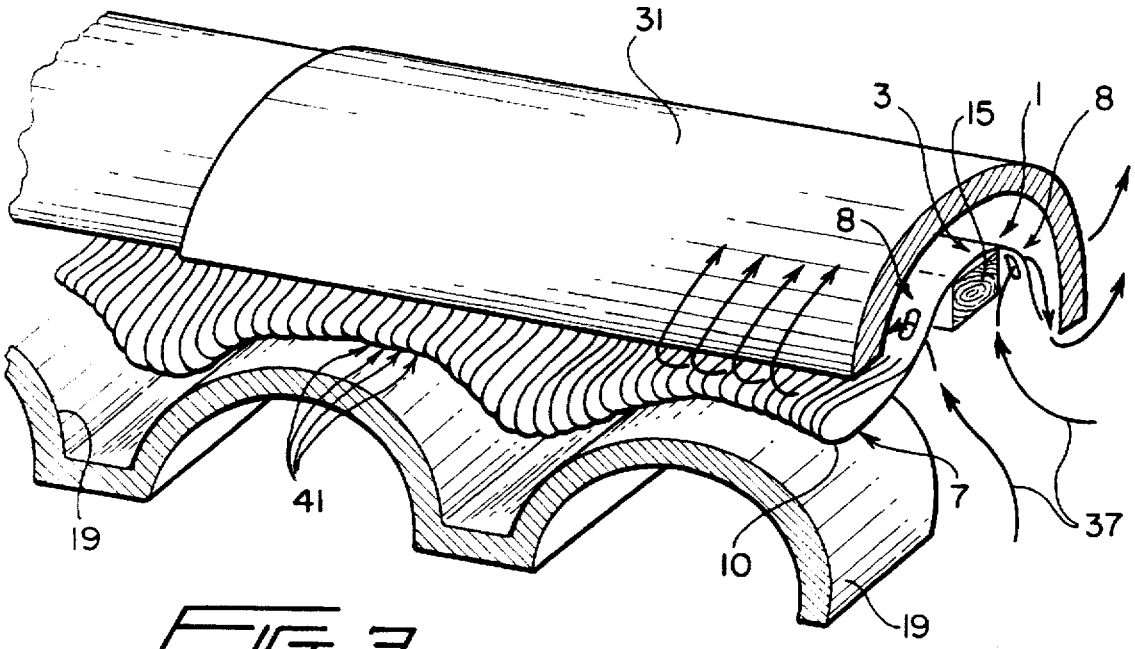
FIG. 3 shows a perspective view of the ridge area of FIG. 1.

FIG. 3 shows a perspective representation of the ridge area of the roof according to FIG. 1. In this embodiment tiles 19 have a corrugated surface on which the sealing member 7 lies, such that sealing of the ridge area against blowing snow and driving rain is ensured. The parts of sealing member 7 produced by the slits lie tightly against one another in the depression between the two corrugations of tile 19 and against the surface of tile 19, while they are spaced apart on the corrugations of tile 17, i.e., the intermediate space between two parts of sealing member 7 is enlarged so that air flow 36 explained in FIG. 1 can flow through hollow body 10 without greater resistance.

In another embodiment, tiles 19 can have a different surface shape against which hollow body 10 rests in a suitable manner. Regardless of the embodiment of tiles 19, the desired seal against blowing snow and driving rain, and the air circulation in the ridge area of the roof, are ensured by ventilation element 1 according to the invention.

Figure 2:
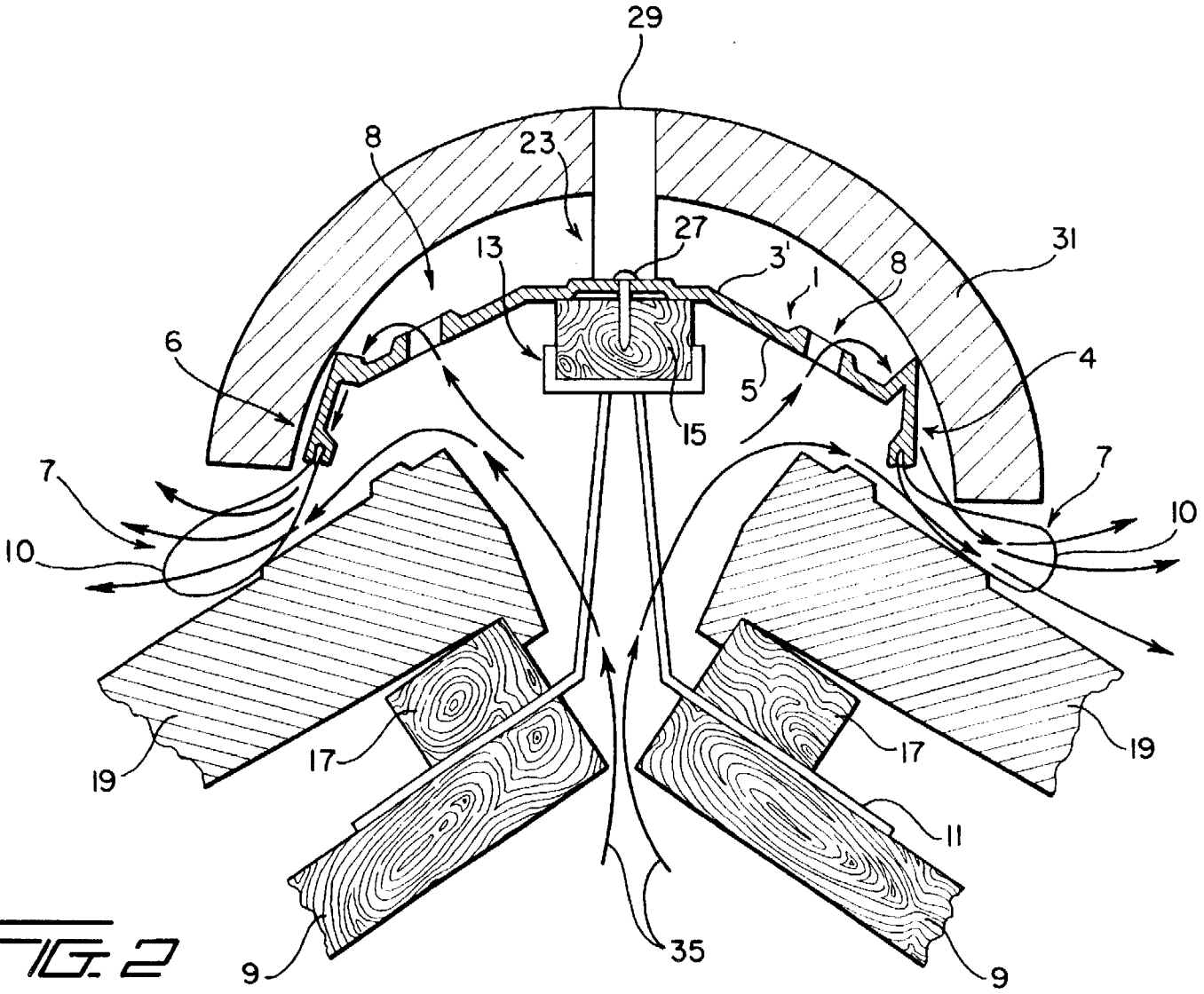
FIG. 2 shows a representation corresponding to FIG. 1, but with a second embodiment of a ventilation element according to the invention.

FIG. 2, likewise, shows a cross section of the roof in the ridge area. Another embodiment of ventilation element 1 is shown. The same parts have the same reference numbers so that reference can be made to the description of FIG. 1 for a description of such parts. However, in this case, vent cap 3' is made of a stiff material so that it also assumes the function of the spacers 21 in the FIG. 1 embodiment, and thus replaces them. Sealing member 7 is attached to edge areas 4, 6 of vent cap 3' in the aforementioned manner.

FIG. 4(*a*) shows a side view and 4(*b*) a plan view of ventilation element 1. Ventilation element 1 has three parts, specifically vent cap 3' and two sealing members 7. In middle area 5 of vent cap 3' there are air passage openings 8 in the form of longitudinal holes. The three parts are made of a flat material, i.e., a mat-like material. For this reason, it is very easily possible to make slits 41 and air passage openings 8.

Figure 5A:
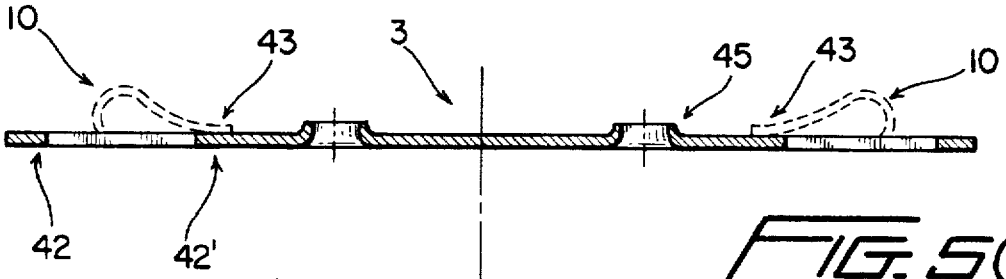
FIGS. 5(*a*) & (*b*) are views corresponding to FIGS. 4(*a*) & (*b*) showing another embodiment of the ventilation element according to the invention.
Figure 5B:
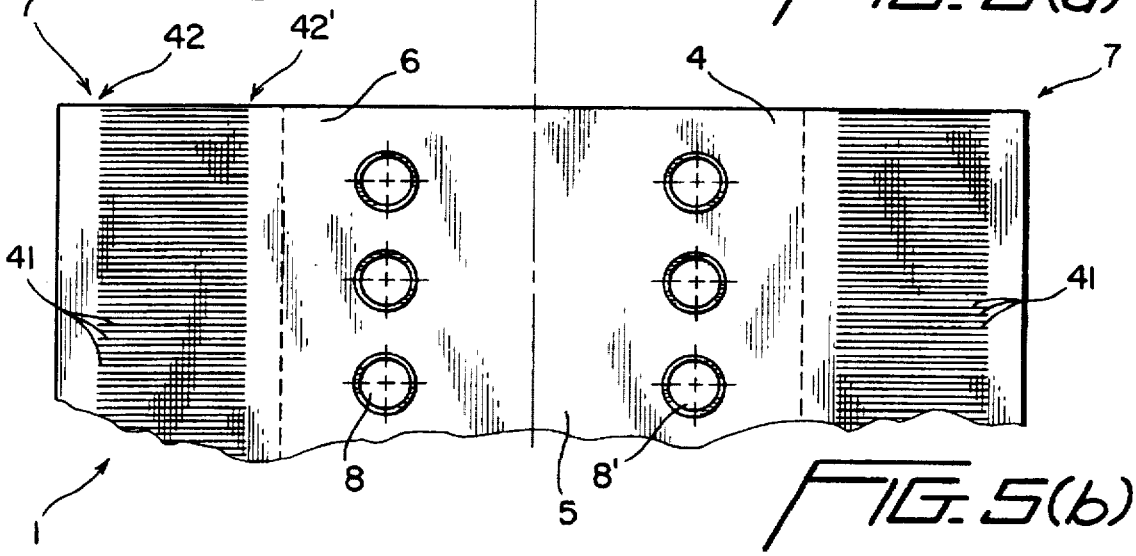
Figure 7A:
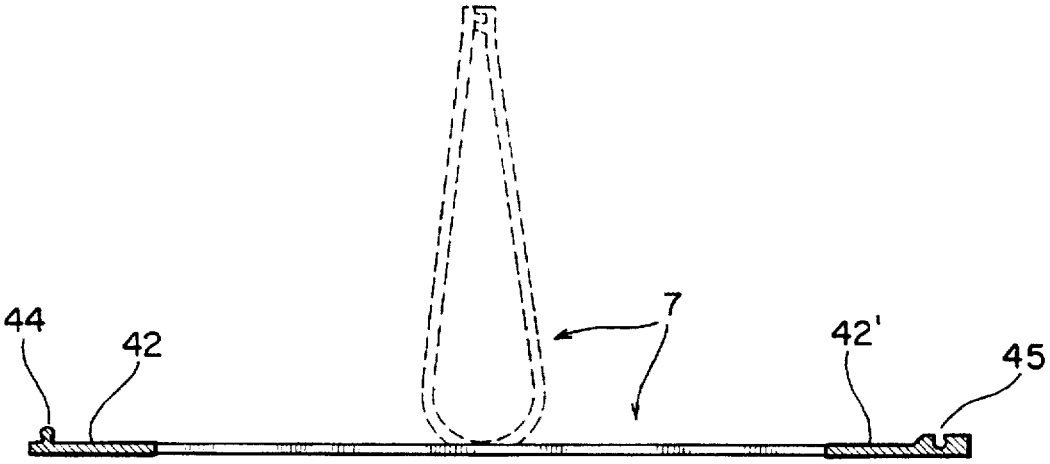
FIGS. 7(*a*), (*b*) & (*c*) show, respectively, a side view, a plan view and a perspective view of another embodiment of the sealing member of a ventilation element according to the invention.
Figure 7B:
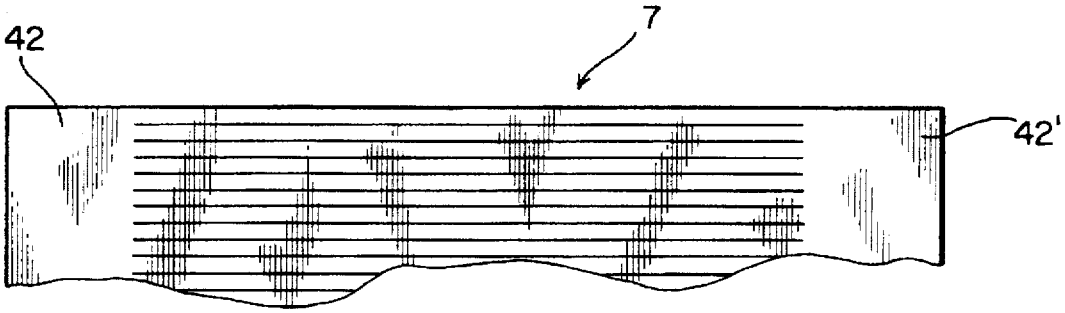
Figure 7C:
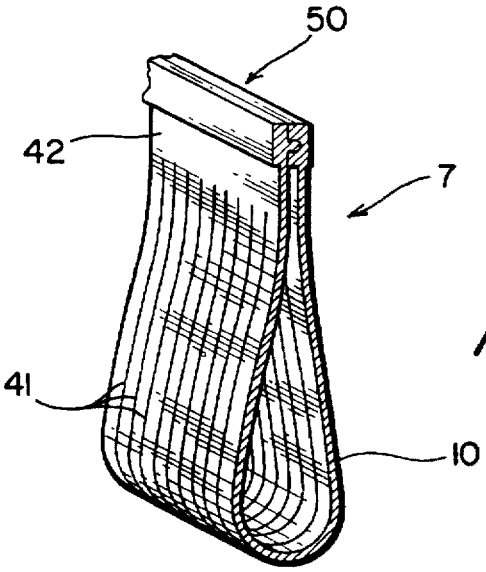

FIGS. 5(*a*) & (*b*) show an embodiment of ventilation element 1 which is made in one piece, i.e., vent cap 3 and sealing members 7 are produced from the same piece of flat material. Such a one-piece ventilation element 1 is preferably produced by extrusion. FIGS. 7(*a*)–(*c*) show a sealing member 7 in which the joined ends 42 and 42' are clipped together in strip form, e.g., by the provision of a projecting bead 44 on end 42 which engages in a mating recess 45 on the end 42' to form a connecting strip 50. A separate clamp bar can also be used for joining ends 42 and 42' together into a connecting strip 50 as in FIG. 9(C). To mount sealing member 7, its connecting strip 50 is pushed into a receiver of vent cap 3; see, FIG. 2.

Figure 8:
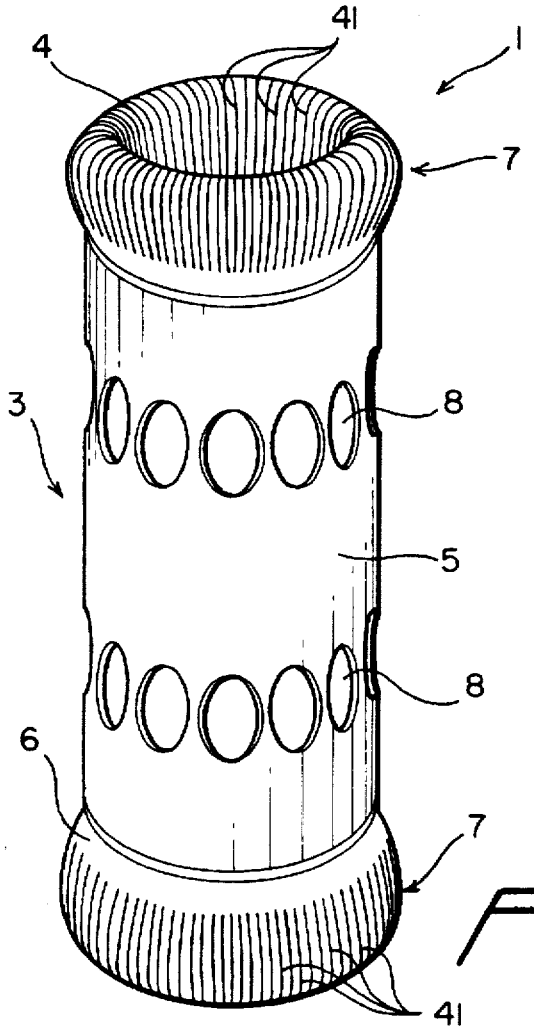
FIG. 8 shows a perspective view of a preferred embodiment of a ventilation element according to the invention.
Figure 9C:
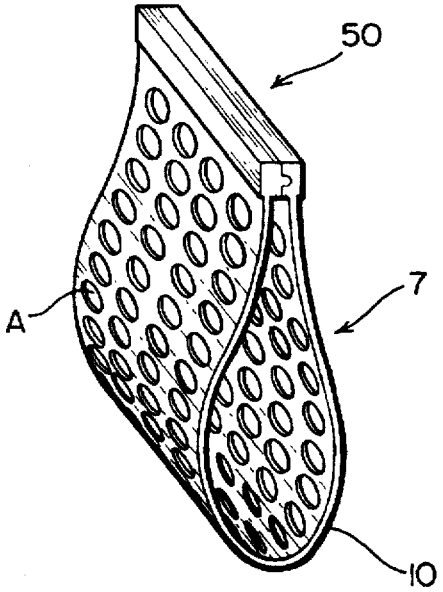

FIG. 8 shows ventilation element 1 according to FIG. 1 in a rolled-up state. The compact form of ventilation element 1 makes it possible to transport it without special cost. Thus, transporting of the ventilation element 1 is greatly simplified.

The sealing element 7 of a one-piece vent cap 3 can have a lower material thickness than vent cap 3. In this way, vent cap 3 is reinforced in an area in which the nail-like pins of spacer 21 penetrate it, yet sealing member 7 maintains its elasticity.

Another embodiment of the ventilation element according to the invention is characterized in that ventilation element 1 is made of different materials. Thus, for example, vent cap 3 can be made of metal and sealing element 7 of plastic.

Figure 9A:
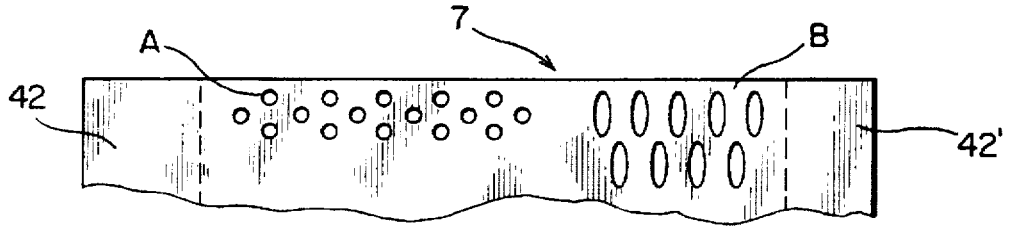
FIGS. 9(*a*), (*b*) & (*c*) show, respectively, a plan view, a modified plan view and a perspective view of another embodiment of the sealing member of a ventilation element according to the invention.
Figure 9B:
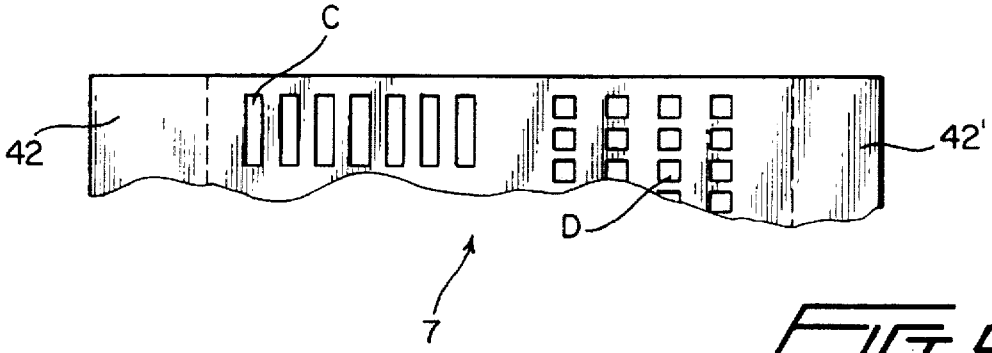
Figure 10A:
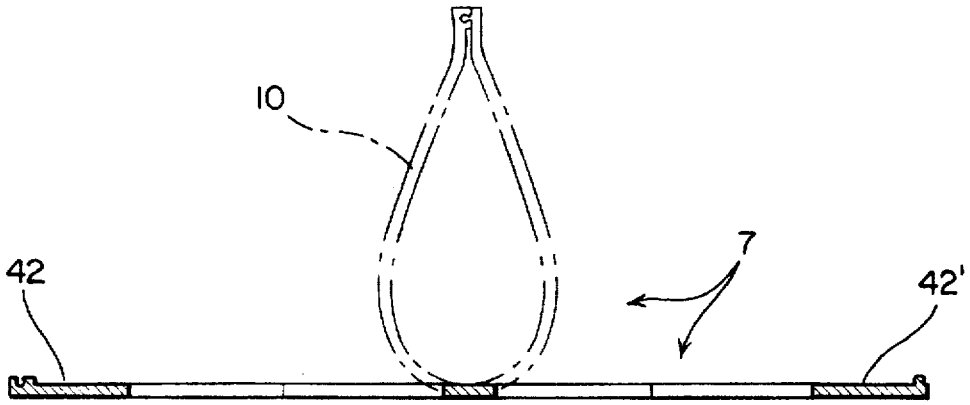
FIGS. 10(*a*) & (*b*) show, respectively, a side view and a plan view of another embodiment of the sealing member of a ventilation element according to the embodiments of FIGS. 7 and 9.
Figure 10B:
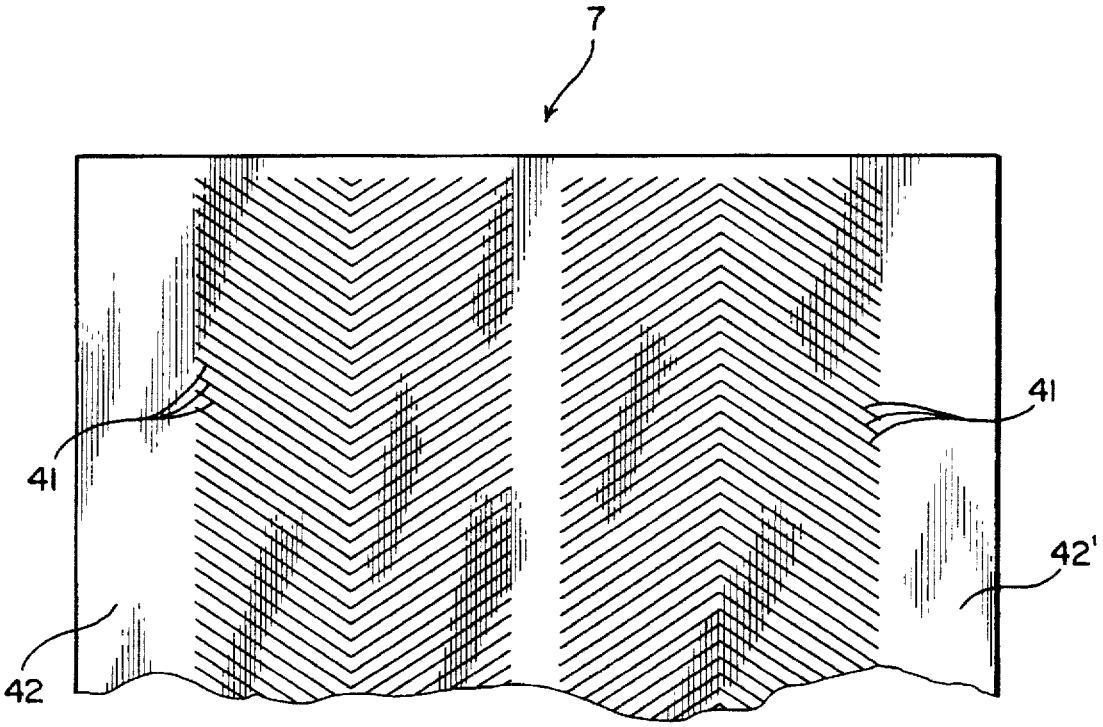

FIG. 9(A) shows a sealing member 7 in which a plurality of circular openings A or oval openings B replace the slits 41, while FIG. 9(B) shows the use of a plurality of elongated rectangular openings C or square openings D are used. FIG. 10 shows a sealing member 7 in which slits 41 have a zig-zag shape.

Figure 11A:
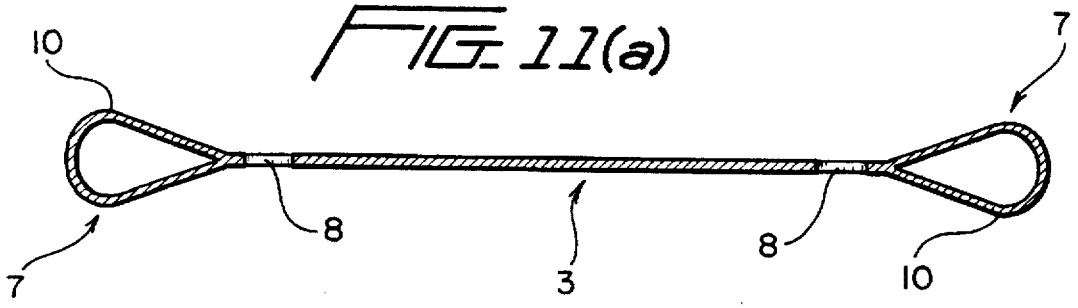
FIGS. 11(*a*) & (*b*) show, respectively, a side view and a plan view of another embodiment of the ventilation element according to the invention which is similar to that shown in FIGS. 4 and 5.
Figure 11B:
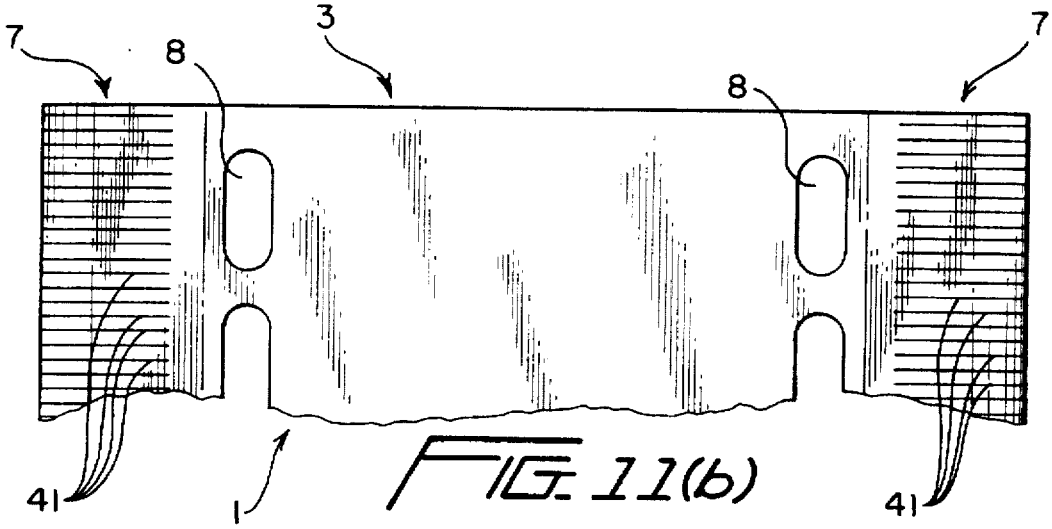

Finally, FIG. 11 shows an embodiment of a ventilation element 1 according to the invention which has been extruded, such that the hollow body 10 is already present after extrusion, and therefore, wrapping or folding of the flat base material is not necessary. Openings 8 and slits 41, would, on the other hand, be provided subsequently in a separate machining operation.

In conclusion, it is pointed out that the ventilation element 1 according to the invention has the major advantage that the sealing members 7 need not be cemented to the roofing material. As a result, ventilation element 1 can be easily placed or replaced in any weather.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A roof ventilation element comprising a vent cap for mounting in a ridge, slope, or arris region of a roof and at least one elastically flexible sealing member which adjoins the vent cap edge areas thereof; wherein the sealing member has a hollow body which is closed in a free end area thereof which is remote from the vent cap and in an area thereof which is adjacent to the vent cap.

2. Roof ventilation element according to claim 1, wherein said hollow body is roughly pear-shaped in cross section.

3. Roof ventilation element according to claim 1, wherein the hollow body is formed a folded-over flat base material.

4. Roof ventilation element according to claim 1, wherein the sealing member is provided with a connecting strip for attachment of the sealing member to the edge area of the vent cap.

5. Roof ventilation element according to claim 1, wherein the hollow body has slits which run transversely to a longitudinal direction of the sealing member.

6. Roof ventilation element according to claim 5, wherein the slits are provided in overlying portions of the hollow body so as to create a flow path through the hollow body.

7. Roof ventilation element according to claim 1, wherein the vent cap and the sealing member are made of a one-piece construction.

8. Ventilation element according to claim 1, wherein ventilation element is a flexible sealing strip which can be wound onto and off of a roll.

9. Roof ventilation element according to claim 1, wherein the vent cap is formed of a material form the group consisting of plastic or metal.

10. Process for producing a roof ventilation element having a vent cap for mounting in a ridge, slope, or arris region of a roof and at least one elastically flexible sealing member which adjoins the vent cap edge areas and which has a hollow body that is closed in a free end area thereof which is remote from the vent cap and in an area thereof which is adjacent to the vent cap, comprising the steps:

extruding the vent cap and a flat base material for the sealing member;

joining the flat base material of the sealing member to an edge area of the vent cap; and forming a hollow body from the flat base material of the sealing member by folding the flat base material and joining a free side of the base material to one of the edge area of the vent cap and an area of the base material which adjoins the edge area of the vent cap.

11. Process for producing a roof ventilation element according to claim 10 wherein the vent cap and the base material for the sealing member are extruded in one piece during said extruding step.

12. Process according to claim 10, wherein said joining is performed by one of welding and cementing.

13. Process for producing a ventilation element according to claim 10, further comprising the step of providing slits in said hollow body which run transversely to a longitudinal direction of the sealing member.

* * * * *